United States Patent [19]

Hendrix

[11] 4,013,398

[45] Mar. 22, 1977

[54] FIREPLACE LIGHTER

[76] Inventor: Henry E. Hendrix, 3404 S. 28th St., Fort Smith, Ark. 72901

[22] Filed: Aug. 11, 1975

[21] Appl. No.: 603,335

[52] U.S. Cl. ..... 431/344; 294/19 R; 431/345

[51] Int. Cl.[2] ..... F23Q 2/00; F23Q 21/00

[58] Field of Search ..... 431/156, 202, 289, 297, 431/343, 344, 345; 294/19 R

[56] References Cited

UNITED STATES PATENTS

| | | | |
|---|---|---|---|
| 676,361 | 6/1901 | Glover | 431/345 X |
| 786,928 | 4/1905 | Williams | 294/19 R |
| 1,752,658 | 4/1930 | Visitacion | 431/202 X |
| 1,909,822 | 5/1933 | Floyd | 431/202 X |
| 2,581,304 | 1/1952 | Sims | 431/345 X |
| 3,781,051 | 12/1973 | Gibson | 294/19 R |

*Primary Examiner*—Robert G. Nilson

*Attorney, Agent, or Firm*—Clarence A. O'Brien; Harvey B. Jacobson

[57] ABSTRACT

An elongated shank is provided having structure on one end defining a handgrip and a longitudinally split sleeve has the side thereof remote from the split portion secured to and extending along the other end portion of the shank. The split sleeve defines a generally cylindrical clamp in that it is constructed of resilient material and the sleeve removably receives a cylindrical butane lighter therein. In this manner, the lighter may be actuated and the shank may be gripped by the end thereof remote from the lighter in order to position the flame of the lighter in an otherwise inaccessible location or a location in which the user of the lighter does not wish to place his hand. Accordingly, the lighter may be utilized to start a fire in a fireplace, to ignite the pilot light of a furnace or hot water heater and to ignite a gas fired outdoor broiler or the like.

3 Claims, 4 Drawing Figures

FIG. 1
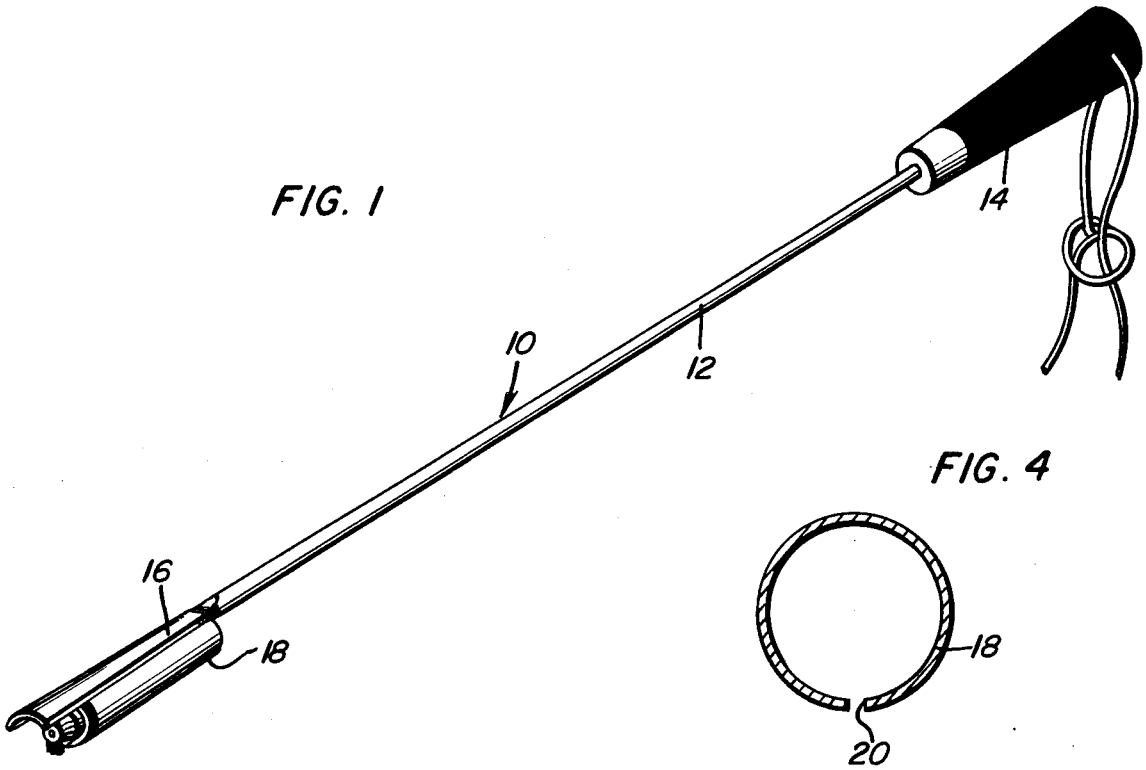
FIG. 4
FIG. 2
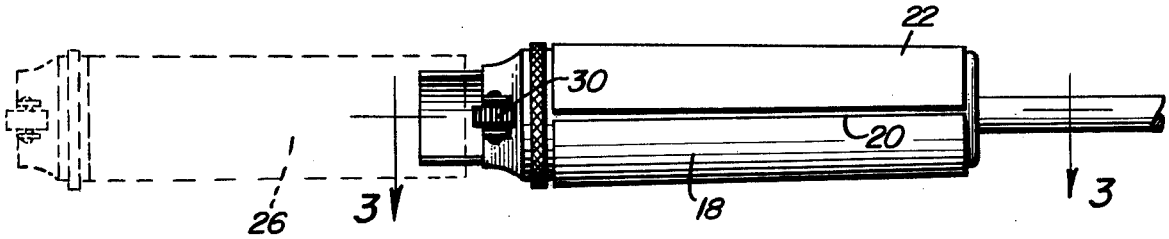
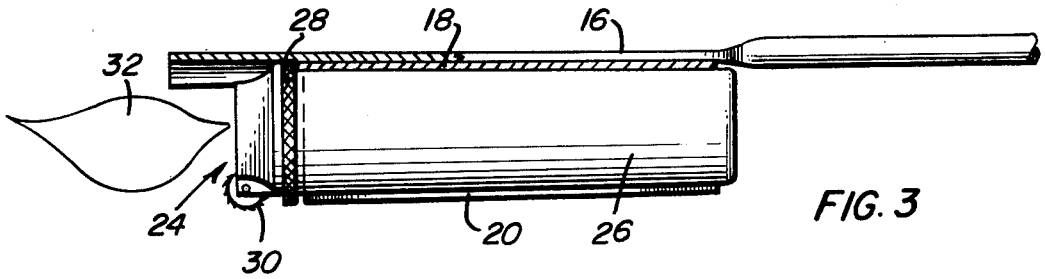
FIG. 3

FIREPLACE LIGHTER

BACKGROUND OF THE INVENTION

Various forms of ignition devices having elongated handles for igniting inaccessible burner elements or the like have been heretofore designed. Examples of some previously patented devices of this type may be found in U.S. Pat. Nos. 2,358,111, 2,581,304, 2,601,455, 3,138,944 and 3,523,005.

However, these previous forms of extension type ignition devices have not been constructed whereby they may be utilized in conjunction with a conventional form of lighter readily removably supported from the handle portion thereof so as to enable a single cigarette lighter of the disposable butane type to be used not only as a portable lighter for carrying by a cigarette or cigar smoker but also as a lighter to be supported from an elongated shank for use as an extension-type lighter.

BRIEF DESCRIPTION OF THE INVENTION

The fireplace or extension lighter of the instant invention consists of a steel cylinder provided with a longitudinal slot extending the full length of one side thereof and the opposite side of the cylinder extends along and is secured to the terminal end of an elongated shank member, the opposite end of the elongated shank member having a handgrip thereon. The longitudinally slotted cylinder is constructed of a heat resistant and at least somewhat resilient material whereby the cylindrical body of a conventional form of butane lighter such as that disclosed in U.S. Pat. No. 3,523,005 may be removably telescoped into the outer end of the cylinder and clampingly supported therein.

The main object of this invention is to provide an extension handle for a conventional form of butane lighter which may be utilized to ignite a burner or fireplace at a position remote from the hand of the user of the lighter.

Another object of this invention is to provide an extension handle for a lighter constructed in a manner whereby a conventional form of butane lighter may be readily removably supported therefrom.

Still another object of this invention is to provide an extension-type support for a lighter utilizing readily available components and which may therefore be readily manufactured from components obtainable from nearby sources thereof.

A final object of this invention to be specifically enumerated herein is to provide an extension-type handle for a butane lighter in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of an extension-type handle for a conventional form of butane lighter equippped with a cylindrical body;

FIG. 2 is a side elevational view of the end of the extension handle remote from the handgrip portion thereof and with a conventional form of butane lighter removably supported therefrom;

FIG. 3 is a fragmentary longitudinal sectional view taken substantially upon the plane indicated by the section line 3—3 of FIG. 2; and FIG. 4 is a transverse sectional view on somewhat of an enlarged scale taken substantially upon a plane passing through the split cylindrical clamp portion of the extension handle.

DETAILED DESCRIPTION OF THE INVENTION

Referring now more specifically to the drawings, the numeral 10 generally designates the extension-type lighter assembly of the instant invention. The assembly 10 includes an elongated rod or shank 12 having a handgrip 14 on one end thereof. The other end of the rod 12 is flattened as at 16 and rendered slightly arcuate in transverse cross section.

A cylindrical body 18 is provided and includes a full length open-ended slot 20. The outer radius of curvature of one end portion 22 of the sleeve 18 is substantially identical with the radius of curvature of the concave side of the flattened end portion 16 and the outer side portion of the end portion 22 remote from the slot 20 is abutted against the concave side of the flattened end portion and rigidly secured thereto in any convenient manner such as by welding, brazing or soldering.

A butane lighter assembly of conventional design is referred to in general by the reference numeral 24. The lighter assembly 24 includes a cylindrical body 26 which may be wedgingly telescopingly received within the cylindrical body or sleeve member 18 from the end thereof remote from the handgrip 14. The lighter assembly 24 may comprise a conventional lighter such as that disclosed in U.S. Pat. No. 3,523,005 and includes a rotatable end portion 28 which may be turned slightly to allow the escape of butane gas from the body 26 of the lighter. The end portion 28 further includes a flint wheel 30 and an associated flint (not shown) and the flint wheel 30 may be turned in order to cause a spark to be generated sufficient to ignite the escaping butane gas. Then, the lighter assembly 10 may be grasped by the handgrip 14 in order to place the flame 32 of the lighter assembly 24 in the desired location. Of course, after the lighter assembly 24 has been used, the end portion 28 of the body may be turned in the opposite direction to prevent further escape of butane gas therefrom.

The lighter assembly 10 may be utilized to provide a flame for lighting gas fireplace starters from a safe distance in order to avoid being burned or singed by "flash-back" that is common with gas fireplace starters and the lighter assembly will also be useful in igniting outdoor gas grilles, fireworks displays, gas furnaces and gas hot water heaters and other hard-to-reach objects such as candles, etc.

Also, it will be noted that the flattened end portion 16 projects appreciably forwardly of the forward end of the sleeve so as to also project at least slightly forwardly of the lighter assembly 24, whereby the forwardly projecting end portion 16 may protect the lighter assembly 24 when the assembly is stood on end with its handle end uppermost.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An extension-type lighter including an elongated generally longitudinally straight shank, means on one end portion of said shank defining a handgrip, support means on the other end portion of said shank including a generally cylindrical sleeve member open at its opposite ends, disposed along said and extending along said shank with one end of said sleeve member opening endwise outwardly of said other end portion of said shank and defining a socket in which to removably telescopically receive a cigarette lighter, said sleeve member including a full length longitudinal slot formed therein opening through the opposite ends of said sleeve member, said sleeve member being constructed of resilient material and at least slightly expandable, the side of said sleeve member remote from said slot extending along and being secured to said other end portion of said shank, a cigarette lighter having a generally cylindrical body including ignition and fuel outlet means at one end thereof, the other end of said body being removably telescoped into and clamped within said one end of said sleeve member with said ignition and fuel outlet means disposed outwardly of said one end of said sleeve member, said other end portion of said shank including an elongated extension projecting endwise outwardly of said one end of said sleeve member and beyond said ignition and fuel outlet means.

2. The combination of claim 1 wherein said sleeve member and body taper slightly toward said one end portion of said shank.

3. The combination of claim 1 wherein said other end portion of said shank and said extension define a concave partial cylindrical recess opening laterally outwardly of and extending along said other end portion of said shank and in which said side of said sleeve member remote from said slot is seated and secured.

* * * * *